US008046855B2

(12) United States Patent
Finch et al.

(10) Patent No.: US 8,046,855 B2
(45) Date of Patent: Nov. 1, 2011

(54) METHOD AND APPARATUS FOR PROVIDING REDUNDANCY IN MONITORING THE LID SWITCH AND BASKET OF A WASHING MACHINE

(75) Inventors: Michael F. Finch, Louisville, KY (US); Donald Richard Dickerson, Jr., Louisville, KY (US); Robert Hollenbeck, Fort Wayne, IN (US); Meher Kollipara, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1004 days.

(21) Appl. No.: 11/835,252

(22) Filed: Aug. 7, 2007

(65) Prior Publication Data

US 2009/0038347 A1 Feb. 12, 2009

(51) Int. Cl.
*D06F 37/02* (2006.01)

(52) U.S. Cl. ..... 8/158; 68/12.26; 68/12.23; 700/2

(58) Field of Classification Search ..... 8/158
See application file for complete search history.

(56) References Cited

U.S. PATENT DOCUMENTS

| | | | |
|---|---|---|---|
| 2,422,395 | A | 6/1947 | Clark |
| 2,813,413 | A | 11/1957 | Leach |
| 2,909,050 | A | 10/1959 | Leach |
| 2,950,612 | A | 8/1960 | Henshaw |
| 3,062,030 | A | 11/1962 | Groves |
| 3,087,321 | A | 4/1963 | Brucken |
| 3,248,909 | A | 5/1966 | Knerr |
| 3,463,285 | A | 8/1969 | Sisler |
| 3,772,925 | A | 11/1973 | Sisson |
| 4,000,968 | A | 1/1977 | Schrage et al. |
| 4,025,883 | A | 5/1977 | Slade et al. |
| 4,255,952 | A | 3/1981 | Johnson |
| 4,317,343 | A | 3/1982 | Gerry |
| 4,371,067 | A | 2/1983 | Gerry |
| 4,749,933 | A | 6/1988 | Ben-Aaron |

(Continued)

FOREIGN PATENT DOCUMENTS

DE 35 13 155 10/1986

(Continued)

OTHER PUBLICATIONS

Office Action dated Aug. 7, 2009 in U.S. Appl. No. 11/498,123, 11 pgs.

(Continued)

*Primary Examiner* — Michael Barr
*Assistant Examiner* — Jason P Riggleman
(74) *Attorney, Agent, or Firm* — Merchant & Gould

(57) ABSTRACT

A method and control system for automatically halting operation of a washing machine by stopping operation of the washing machine motor is provided. The washing machine that implements the method includes a motor controller having a primary microprocessor and a secondary microprocessor which serves as a backup redundancy processor in the event there is a malfunction with the primary microprocessor or the primary microprocessor fails to halt washing machine operation within a prescribed window of time. The primary microprocessor controls operation of all of the washing machine electrically controlled components. The secondary microprocessor is electrically connected to a lid switch and the washing machine motor and is configured to halt operation of the motor in response to the primary microprocessor failing to halt motor operation after the lid is open.

20 Claims, 11 Drawing Sheets

U.S. PATENT DOCUMENTS

| | | | | |
|---|---|---|---|---|
| 4,946,012 | A | 8/1990 | Foster | |
| 4,950,918 | A | 8/1990 | O'Breartuin et al. | |
| 5,006,744 | A | 4/1991 | Archer et al. | |
| 5,042,276 | A | 8/1991 | Kamano et al. | |
| 5,786,996 | A * | 7/1998 | Vitkus et al. | 700/82 |
| 5,810,111 | A | 9/1998 | Takeuchi et al. | |
| 5,838,127 | A | 11/1998 | Young et al. | |
| 5,913,952 | A | 6/1999 | Kim | |
| 5,926,887 | A | 7/1999 | Thompson et al. | |
| 6,189,171 | B1 | 2/2001 | Savkar et al. | |
| 6,257,027 | B1 | 7/2001 | Imai | |
| 6,369,538 | B1 | 4/2002 | Youn et al. | |
| 6,445,879 | B1 | 9/2002 | Youn et al. | |
| 6,477,866 | B1 | 11/2002 | Chamberlin et al. | |
| 6,479,916 | B1 | 11/2002 | Bobay et al. | |
| 6,748,618 | B1 | 6/2004 | Darby et al. | |
| 6,989,616 | B2 | 1/2006 | Okubo et al. | |
| 7,047,770 | B2 | 5/2006 | Broker et al. | |
| 7,150,167 | B2 | 12/2006 | Tomigashi et al. | |
| 7,352,092 | B2 | 4/2008 | Levine et al. | |
| 7,462,965 | B2 | 12/2008 | Natsuhara et al. | |
| 2004/0103694 | A1 | 6/2004 | Bang et al. | |
| 2005/0120759 | A1 | 6/2005 | Choi et al. | |
| 2006/0000031 | A1 | 1/2006 | Hoppe et al. | |
| 2006/0130242 | A1 | 6/2006 | Hoppe et al. | |
| 2006/0208582 | A1 | 9/2006 | Marioni | |
| 2008/0041114 | A1 * | 2/2008 | Dickerson et al. | 68/12.01 |

FOREIGN PATENT DOCUMENTS

| | | | |
|---|---|---|---|
| DE | 197 23 664 | | 12/1997 |
| JP | 04-362321 | | 12/1992 |
| JP | 07-000672 | | 1/1995 |
| JP | 2001-000775 | | 1/2001 |
| JP | 2001-000779 | | 1/2001 |
| JP | 2001-017778 | | 1/2001 |
| JP | 2001113082 | A | 4/2001 |
| JP | 2001-300187 | | 10/2001 |
| JP | 2001340685 | | 12/2001 |
| JP | 2003088168 | A | 3/2003 |
| JP | 2003-284894 | | 10/2003 |
| JP | 2003305294 | A | 10/2003 |
| JP | 2004-209132 | | 7/2004 |
| JP | 2005261957 | A | 9/2005 |
| KR | 1020040046047 | * | 6/2004 |

OTHER PUBLICATIONS

Office Action dated Jan. 7, 2010 in U.S. Appl. No. 11/498,123, 8 pgs.

Office Action dated Jun. 14, 2010 in U.S. Appl. No. 11/498,123, 8 pgs.

Office Action dated Oct. 28, 2010 in U.S. Appl. No. 11/498,123, 9 pgs.

Office Action dated Jul. 14, 2011 in U.S. Appl. No. 11/498,123, 8 pgs.

* cited by examiner

METHOD AND APPARATUS FOR PROVIDING REDUNDANCY IN MONITORING THE LID SWITCH AND BASKET OF A WASHING MACHINE

FIELD OF INVENTION

The present invention relates generally to washing machines, and more particularly to washing machine braking system control redundancy.

BACKGROUND OF THE INVENTION

A typical washing machine for washing clothing goes through a wash cycle which includes a number of modes of operation. Generally, the wash cycle includes an agitation mode in which the clothes are agitated in detergent, a rinse mode, and a spin mode in which water is removed from the clothes.

Washing machines generally include two components which come into contact with the clothes, the basket and the agitator. The basket is typically a cylindrical container which holds the clothes to be washed and which may have holes in its walls to drain the washing liquid (e.g., detergent and water) during the spin cycle. The agitator is located within the basket and serves to agitate the clothes and the wash liquid in the basket. The combination of the mechanical action of the agitator and the chemical action of the wash liquid washes the clothes. The basket and agitator are generally located within a second container conventionally known as the tub. The tub keeps the wash liquid within the basket during the wash cycle.

To power the agitator and the basket, a conventional induction motor may be used. The basket and agitator each have drive shafts, which may be concentric, for independently driving their respective motions. The agitator drive shaft may be connected to the motor through a transmission. The transmission reduces motor speed and converts the rotary motion of the motor into an oscillatory output for the agitator drive shaft. The basket drive shaft is typically connected to the motor through the outer case of the transmission.

During the agitation mode, the basket drive shaft is held stationary while the agitator drive shaft is oscillated. The basket drive shaft is typically locked to the washer frame through a brake and carries the reaction forces from the transmission during agitation into the frame. During the spin mode, power is applied to the basket drive shaft, and both the agitator and basket drive shafts are rotated together. During spin mode, the brake is released so the basket and agitator can be spun up to a high speed to expel wash water from the clothes through holes in the basket.

To switch from agitation mode to spin mode, a mode shifter is used. The mode shifter changes the point of power application from the agitator to the basket. An automatic brake is also provided to quickly stop the basket to avoid an accident if the washer lid is raised during the spin mode. There are many known ways of achieving the mode shift and brake functions. A common problem with many systems is the level of mechanical complexity of each, which adversely effects cost and reliability. There is a need for mode shifters which are more mechanically simple and inexpensive. Such systems need to overcome the problems encountered in known systems while at the same time not creating new problems such as safety concerns which would result if the washer fails to shut down when the washer lid is opened during operation.

SUMMARY OF THE INVENTION

Consistent with embodiments of the present invention, systems and methods are disclosed for controlling a mode shifter in a washing machine with a mode controller. The mode controller facilitates the automatic halting of the operation of a washing machine by stopping operation of the washing machine motor. The washing machine that implements the method includes a motor controller having a primary microprocessor and a secondary microprocessor which serves as a backup redundancy processor in the event there is a malfunction with the primary microprocessor or the primary microprocessor fails to halt washing machine operation within a prescribed window of time. The primary microprocessor controls operation of all of the washing machine electrically-controlled components. The secondary microprocessor is electrically connected to a lid switch and the washing machine motor and is configured to halt operation of the motor in response to the primary microprocessor failing to halt motor operation.

It is to be understood that both the foregoing general description and the following detailed description are examples and explanatory only, and should not be considered to restrict the invention's scope, as described and claimed. Further, features and/or variations may be provided in addition to those set forth herein. For example, embodiments of the invention may be directed to various feature combinations and sub-combinations described in the detailed description.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

Figure 1:
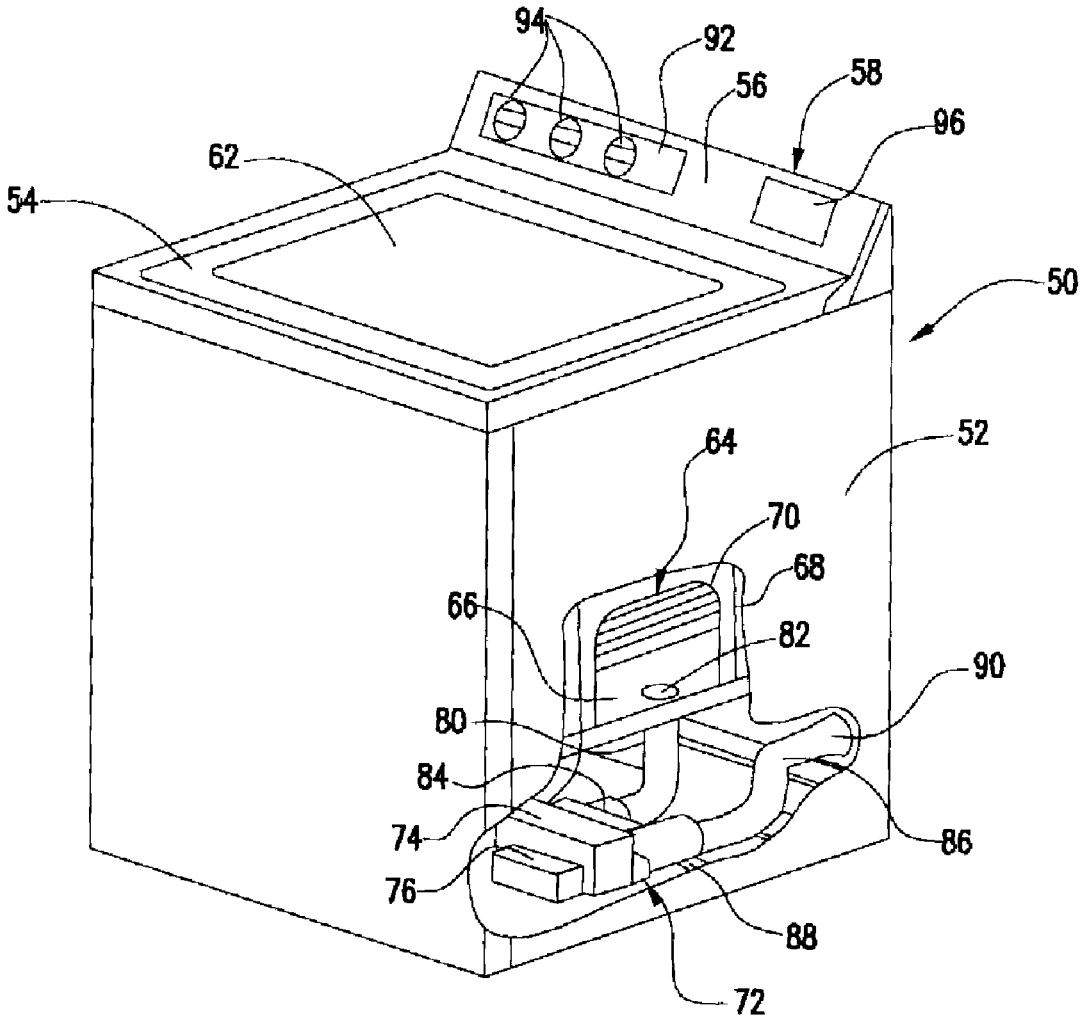
FIG. 1 is a perspective view of an exemplary washing machine with a portion of a washing machine cabinet removed.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention. Instead, the proper scope of the invention is defined by the appended claims.

Consistent with embodiments of the present invention, a method and apparatus for reducing wiring required to electrically couple components housed within a washing machine. The washing machine components are wired and configured to facilitate a backup breaking system. In one embodiment, a motor controller is electrically coupled to a motor and a mode shifter housed within the washing machine. By coupling the motor controller to the motor and the mode shifter, additional wiring is not required to electrically couple a washing machine control board to the motor and the mode shifter. Further, affixing the motor controller to a top portion of the motor reduces an amount of wire that extends between the motor controller and the motor and the mode shifter. In a particular embodiment, the motor controller is configured to provide a pulse width modulated direct current voltage to the mode shifter for facilitating limiting power received by the made shifter to a necessary amount of power to prevent or limit mode shifter overheating. In a particular embodiment the motor controller includes two microprocessors. A first microprocessor serves as the primary processor within the controller. A second microprocessor serves as a backup redundancy processor to the primary microprocessor and is configured to monitor a washing machine lid switch and pulses within the washing machine motor. In the event that there is a malfunction with the primary microprocessor or the primary microprocessor fails to halt the washing machine motor within a prescribed window of time, the secondary microprocessor causes the washing machine motor to stop.

The present invention is described below in reference to its application in connection with and operation of a washing machine. However, it will be apparent to those skilled in the art and guided by the teachings herein provided that the invention is likewise applicable to any suitable electrical and/or electronic appliance.

FIG. 1 is a perspective view of an exemplary washing machine 50 including a cabinet 52 and a cover 54. A portion of cabinet 52 is removed to show material features and/or components of washing machine 50. A backsplash 56 extends from cover 54, and a washing machine control board assembly 58 is coupled to backsplash 56. A lid 62 is mounted to cover 54 and is movable between an open position (not shown) facilitating access to a wash tub 64 located within cabinet 52, and a closed position (shown in FIG. 1) forming a sealed enclosure over wash tub 64.

Wash tub 64 includes a bottom wall 66, a sidewall 68, and a basket 70 rotatably mounted within wash tub 64. A pump assembly 72 is located beneath wash tub 64 and basket 70 for gravity assisted flow when draining wash tub 64. Pump assembly 72 includes a pump 74 and a motor 76. A pump inlet hose 80 extends from a wash tub outlet 82 in bottom wall 66 to a pump inlet 84, and a pump outlet hose 86 extends from a pump outlet 88 to a water outlet 90 and ultimately to a building plumbing system discharge line (not shown) in flow communication with water outlet 90.

Further, in the exemplary embodiment, washing machine control board assembly 58 includes a control panel 92 and a plurality of input selectors 94, which collectively form a user interface input for operator selection of machine cycles and/or features. In one embodiment, a display 96 indicates selected features, a countdown timer, and/or other items of interest to machine users.

Figure 2:
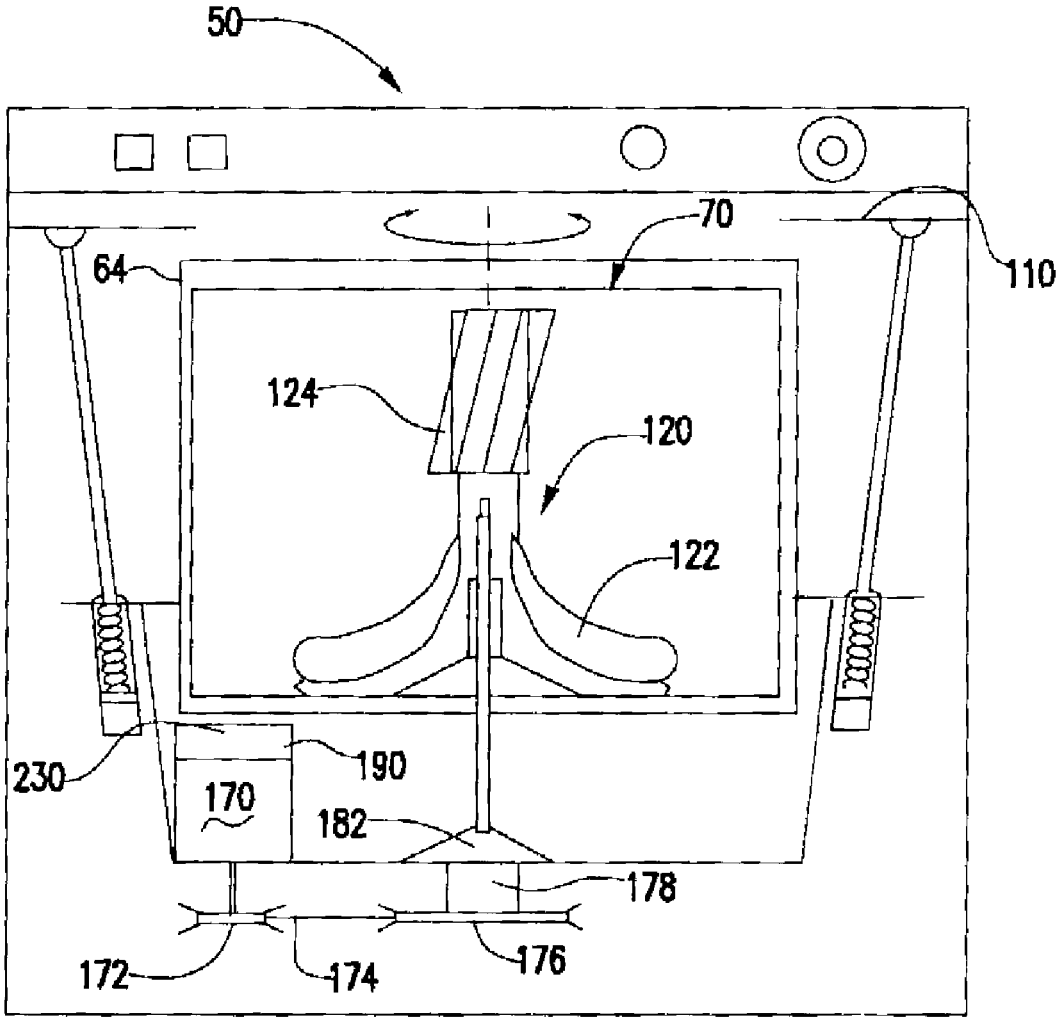
FIG. 2 is a schematic sectional view of the washing machine shown in FIG. 1.

FIG. 2 is a schematic view of washing machine 50. Washing machine 50 includes a frame 110 for supporting the components of the washing machine 50, basket 70 for holding articles such as clothes to be washed, and an agitator 120 for agitating the clothes in basket 70. In one embodiment, agitator 120 is molded with a plastic material, such as polypropylene, and includes a plurality of vanes 122. Vanes 122, which are typically flexible, mechanically agitate the clothes back and forth within the basket. In a particular embodiment, washing machine 50 includes an auger 124 at the top of agitator 120. Auger 124 further enhances the movement of the clothes within basket 70. Basket 70 and agitator 120 sit within wash tub 64, which retains the wash water during the wash cycle.

To power washing machine 50 a motor 170, such as a 3-phase motor, is provided. Motor 170 is coupled to the basket 70 and agitator 120 through a motor pulley 172, a belt 174, a drive pulley 176, a mode shifter 178, and basket and agitator drive shafts. Mode shifter 178 enables motor 170 to execute an agitation mode and a spin mode.

A motor controller 190 is affixed to a top portion of motor 170. In the exemplary embodiment, motor controller 190 is independently electrically coupled to motor 170 and mode shifter 178 for facilitating providing power to and operating motor 170 and/or mode shifter 178. Motor controller 190 is also electrically coupled to washing machine control board assembly 58 such that input into washing machine control board assembly 58 manipulates or controls operation of motor 170 and/or mode shifter 178. Because motor controller 190 is coupled to motor 170, the present invention facilitates reducing wiring within washing machine 50. Specifically, only the wires that electrically couple washing machine control board assembly 58 to motor controller 190 are required to extend from washing machine control board assembly 58 to a lower portion of washing machine 50. Further, the amount of wire needed to electrically couple motor controller 190 to motor 170 and mode shifter 178 is reduced. As such, an amount of wiring throughout washing machine 50 is reduced. Controller 190 includes a plurality of electrical components and two microprocessors. A first microprocessor controls operation of all washing machine operational components. A second microprocessor serves as a backup microprocessor that monitors the washing machine lid switch and the RPM of the motor 170. The RPM is monitored via Hall Effect sensors. When the shaft of motor 170 is rotating primary microprocessor 414 and a secondary microprocessor 420 are receiving an indication of such rotations. The secondary microprocessor is configured to halt movement of the motor 170 and thereby the basket 70 and agitator 120 by disabling the washing machine 50 when its operation is not stopped by microprocessor 414 within a predetermined amount of time.

Mode shifter 178 includes an inductive power solenoid, described in detail below, which enables motor 170 to execute an agitation mode and a spin mode. In one embodiment, during the agitation mode, mode shifter 178 is energized to couple motor 170 to agitator 120. As such, only agitator 120 is rotated during the agitation mode. Further, during the spin mode, mode shifter 178 is deenergized to couple both basket 70 and agitator 120 to motor 170. As such, agitator 120 and basket 70 are rotated during the spin mode.

Figure 3:
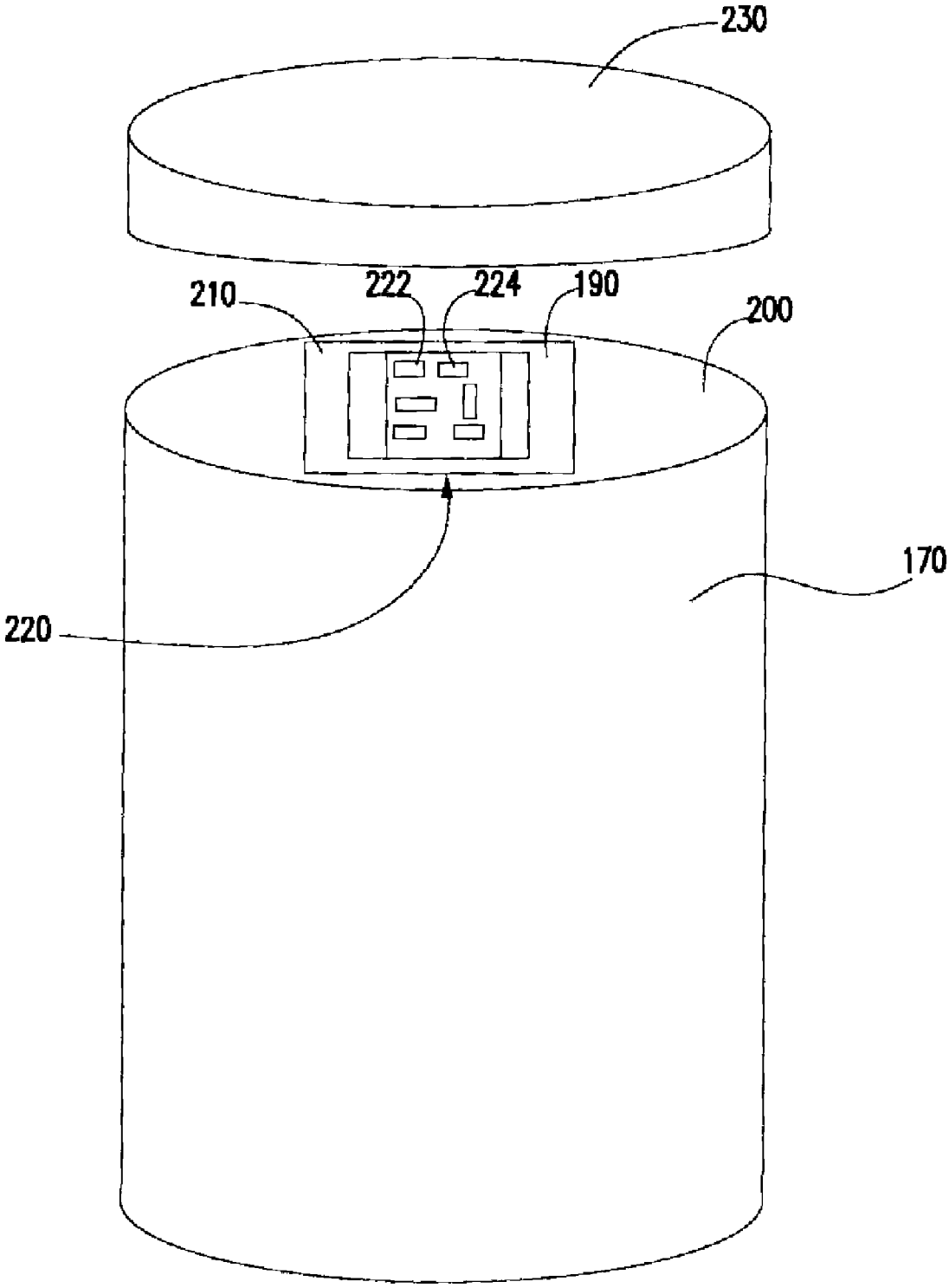
FIG. 3 is an exemplary embodiment of the motor shown in FIG. 2 and coupled to the motor controller shown in FIG. 2.

FIG. 3 is an exemplary embodiment of motor 170 affixed to motor controller 190. In one embodiment, motor controller 190 is affixed to a top portion 200 of motor 170. In this embodiment, motor 170 is a 3-phase motor. In alternative embodiments, motor 170 is any motor suitable for operating washing machine 50 as described herein. Motor controller 190 includes a circuit board 210 having a plurality of electronic components 220 coupled thereto, as described in greater detail below in reference to FIG. 10. The electrical components 220 include at least a primary microprocessor 222 and a backup microprocessor 224 which serves as a redundancy monitor of the washing machine lid switch 422 and the pulses from the Hall Effect sensors within the motor controller 190. A shield 230 is coupled to motor controller 190 and acts as a heat sink for motor controller 190. Further, shield 230 prevents or limits water within washing machine 50 from contacting motor controller 190.

Figure 4:
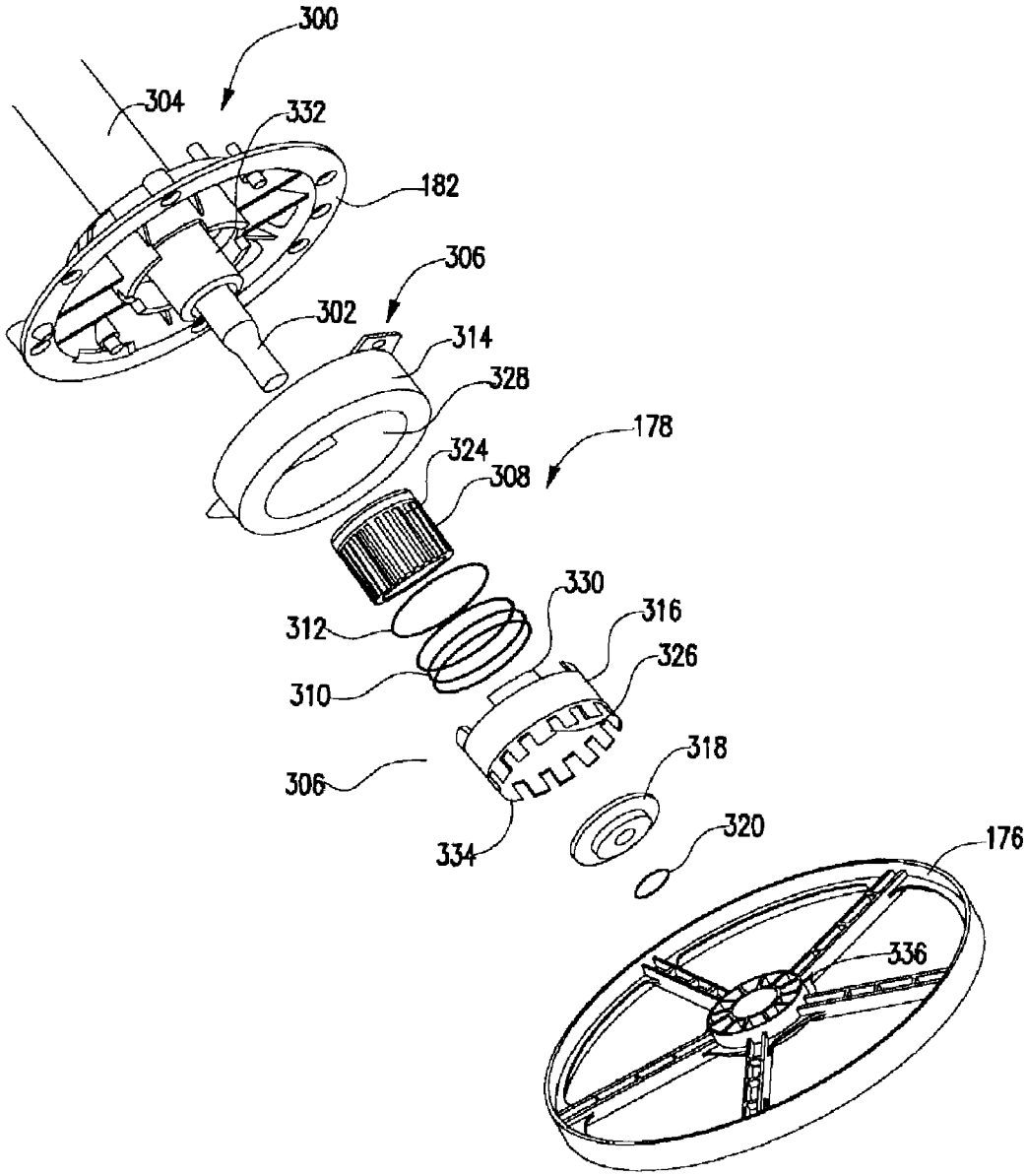
FIG. 4 is an exploded perspective view of the mode shifter shown in FIG. 2 coupled to a shaft assembly and the pulley shown in FIG. 2.
Figure 5:
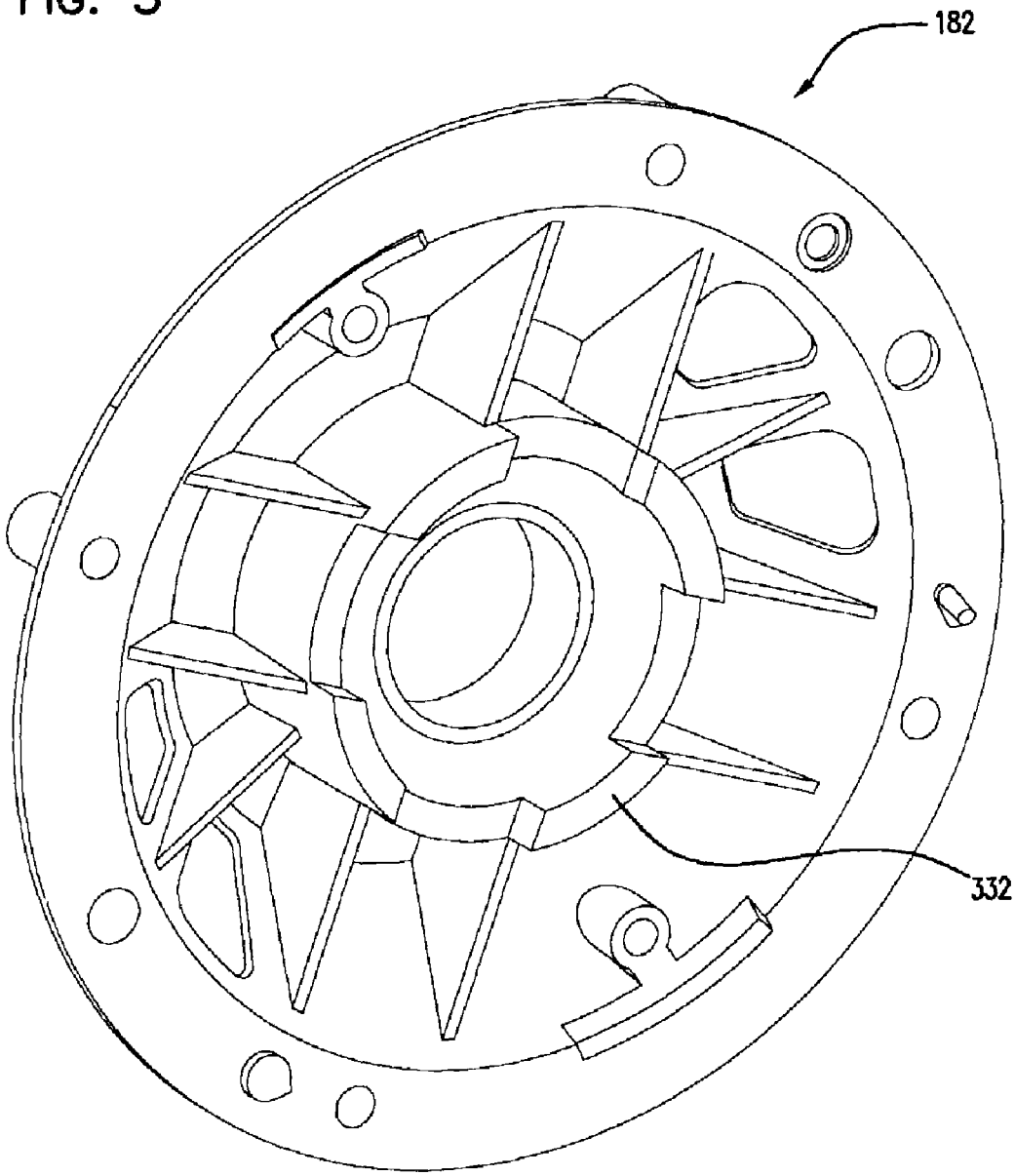
FIG. 5 is a perspective view of the bearing retainer assembly shown in FIG. 4.

FIG. 4 is an exploded perspective view of mode shifter 178 coupled to drive pulley 176 and a shaft assembly 300. Specifically, shaft assembly 300 includes an agitator shaft 302, a spin tube 304, and bearing retainer assembly 182, as is shown in FIG. 5. Mode shifter 178 includes a solenoid 306, a clutch 308, a spring 310, and a washer 312. Solenoid 306 includes a bracket assembly 314 and an armature assembly 316.

Figure 6:
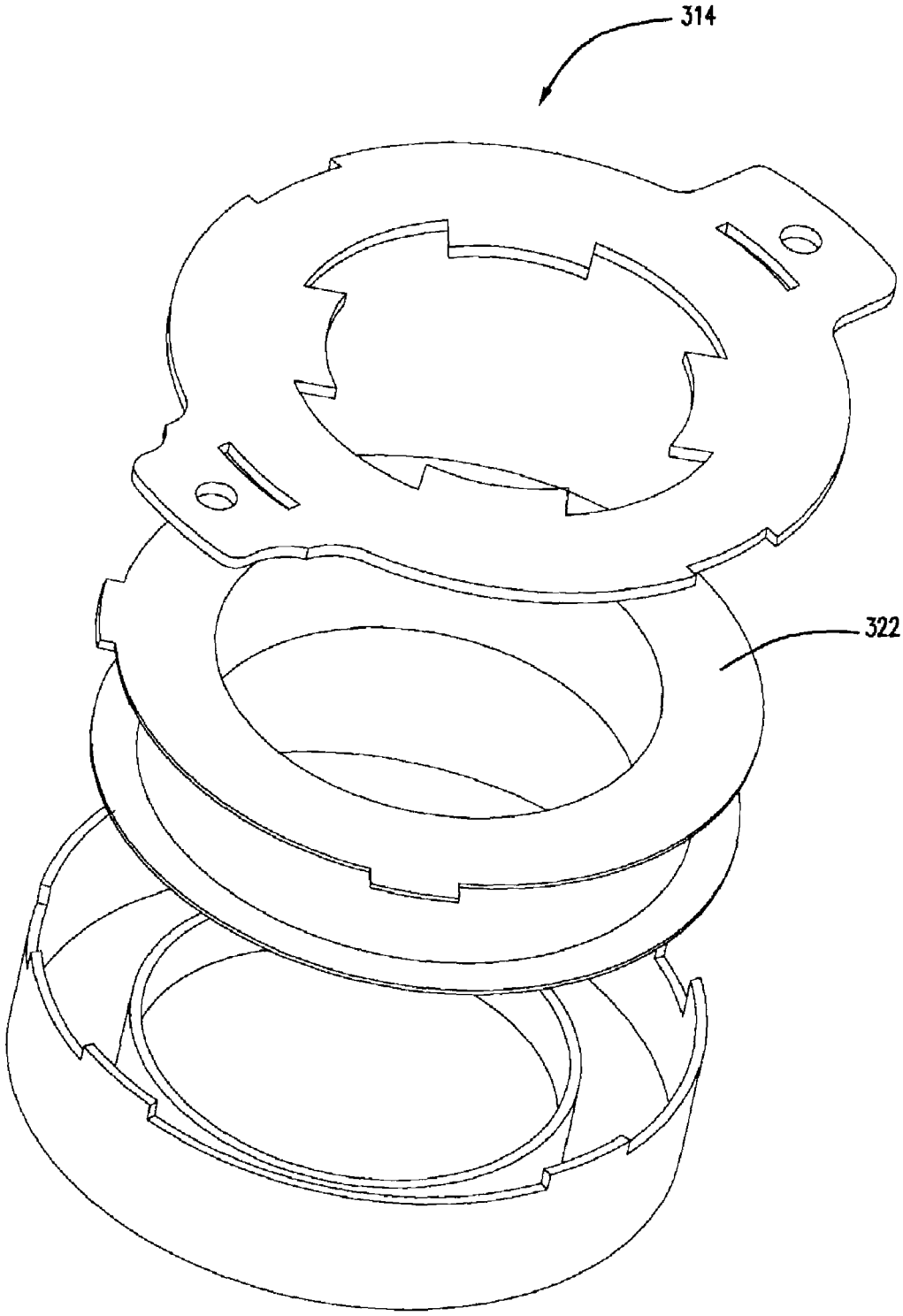
FIG. 6 is a perspective view of the bracket assembly shown in FIG. 4.

Drive pulley 176 is coupled to agitator shaft 302, which extends though spin tube 304 and is movable with respect to spin tube 304. In this embodiment, a spacer armature 318 and a retaining ring 320 are coupled between drive pulley 176 and agitator shaft 302. Agitator shaft 302 is coupled to agitator 120 and spin tube 304 is coupled to basket 70. Bearing retainer assembly 182 is positioned circumferentially around spin tube 304 and is coupled within washing machine 50. Bearing retainer assembly 182 includes dogs or other suitable projections for retaining basket 70 properly positioned during the agitation mode. Bearing retainer assembly 182 is also coupled to solenoid bracket assembly 314, which includes an inductive coil 322 positioned therein, as shown in FIG. 6.

Figure 7:
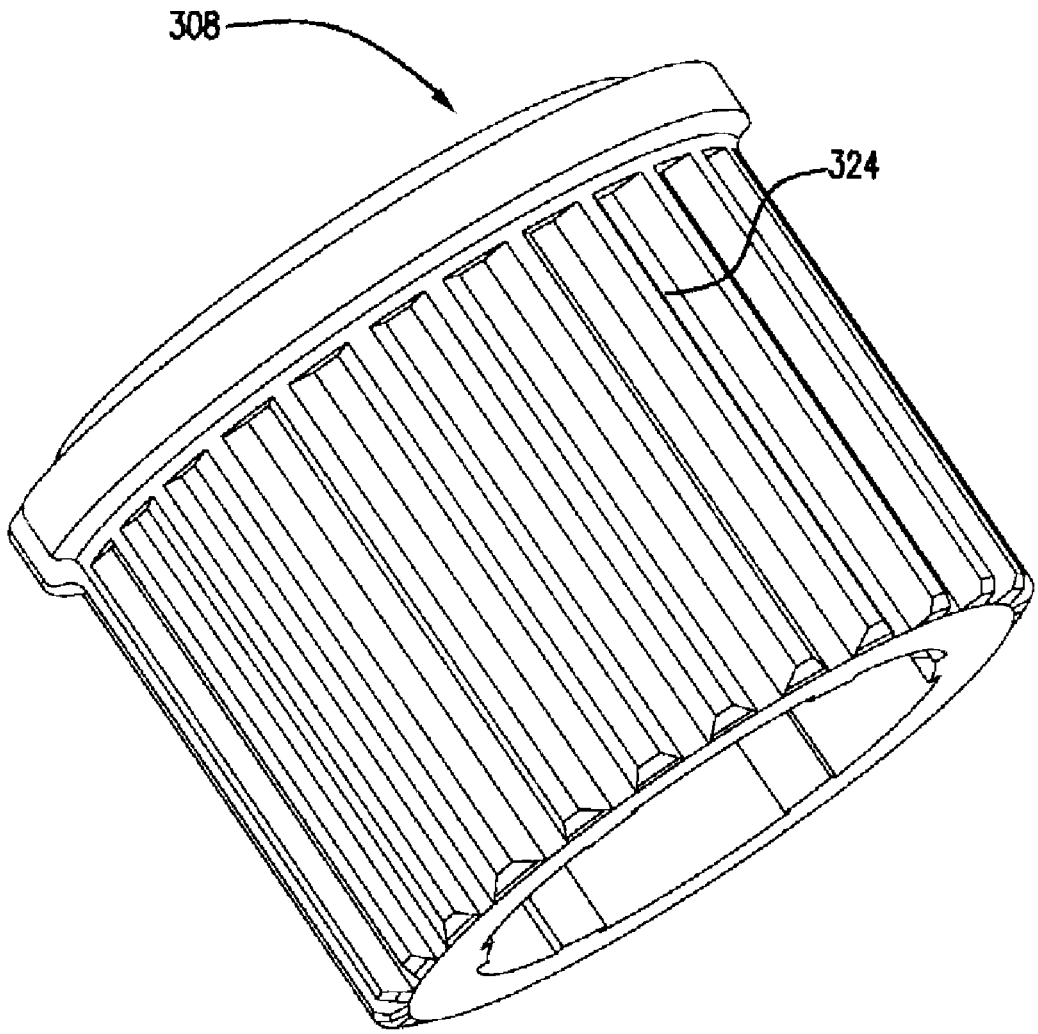
FIG. 7 is a perspective view of the clutch shown in FIG. 4.
Figure 8:
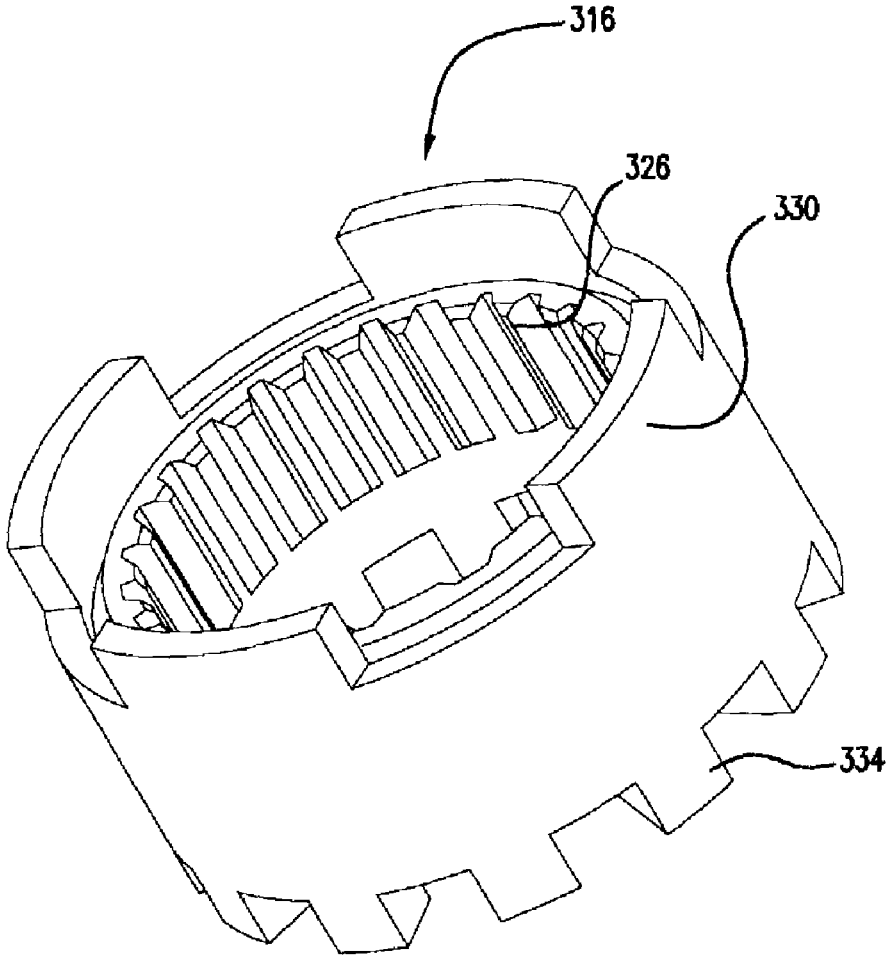
FIG. 8 is a perspective view of the armature assembly shown in FIG. 4.

Clutch 308 is coupled to spin tube 304 and armature assembly 316. In one embodiment, a plurality of splines 324 formed on an outer surface of clutch 308, as shown in FIG. 7, engage or interfere with a plurality of splines 326 formed on an inner surface of armature assembly 316, as shown in FIG. 8. Splines 324 and splines 326 are engaged such that armature assembly 316 can slide between a upper position and a lower position. Specifically, armature assembly 316 is positioned within a bore 328 formed in bracket assembly 314 such that energizing and deenergizing an inductive current in inductive coil 322 causes armature assembly 316 to slide along clutch 308 between the upper position and the lower position.

Figure 9:
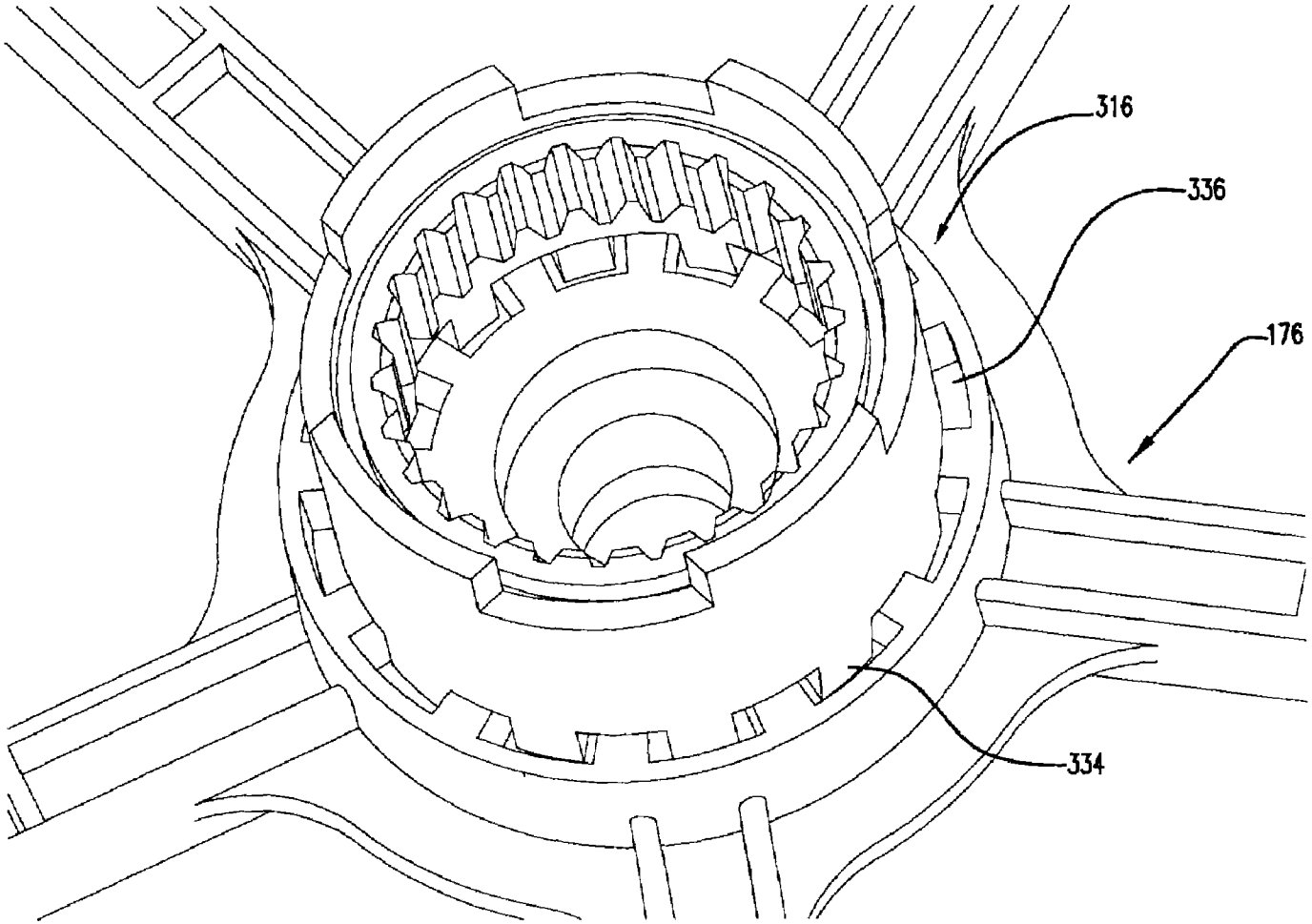
FIG. 9 is a perspective view of the armature assembly shown is FIGS. 4 and 8 coupled to the drive pulley shown in FIG. 4.

With inductive coil 322 energized, armature assembly 316 is in the upper position. In the upper position, armature assembly 316 is configured to couple to bearing retainer assembly 182. Specifically, a plurality of teeth 330 formed on armature assembly 316, as shown in FIG. 8, are configured to engage or cooperate with a plurality of teeth 332 formed on bearing retainer assembly 182, as shown in FIG. 5. With inductive coil 322 deenergized, armature assembly 316 moves into the lower position. In the lower position, a plurality of teeth 334 formed on armature assembly 316, as shown in FIG. 8, engage or cooperate with a plurality of notches 336 formed in drive pulley 176, as shown in FIG. 9. Washer 312 and spring 310 are coupled between armature assembly 316 and clutch 308 for facilitating movement of armature assembly 316 with respect to clutch 308. Specifically, spring 310 is configured to provide a resistant force against armature assembly 316 as armature assembly 316 moves into the upper position.

In one embodiment, during operation of washing machine 50, solenoid 306 is energized by motor controller 190. In the energized state, armature assembly 316 is in the upper position. In the upper position, armature assembly 316 is disengaged from drive pulley 176 and engaged with bearing retainer assembly 182. As such, bearing retainer assembly 182 prevents armature assembly 316 from rotating such that basket 70 does not rotate. Motor controller 190 powers motor 170 causing drive pulley 176 to rotate. The rotation of drive pulley 176 rotates agitator shaft 302 such that only agitator 120 rotates when solenoid 300 is energized, referred to herein as the agitation mode for washing machine 50.

When the spin mode of washing machine 50 is required, motor controller 190 deenergizes solenoid 306 causing armature assembly 316 to slide into the lower position. In the lower position, armature assembly 316 is engaged with drive pulley 176. Drive pulley 176 rotates to rotate agitator shaft 302 causing agitator 120 to rotate. Because armature assembly 316 is engaged with drive pulley 176, armature assembly 316 also rotates causing clutch 308 to rotate. The rotation of clutch 308 causes spin tube 304 and basket 70 to rotate such that agitator 120 and basket 70 rotate together in the spin mode.

Figure 10:
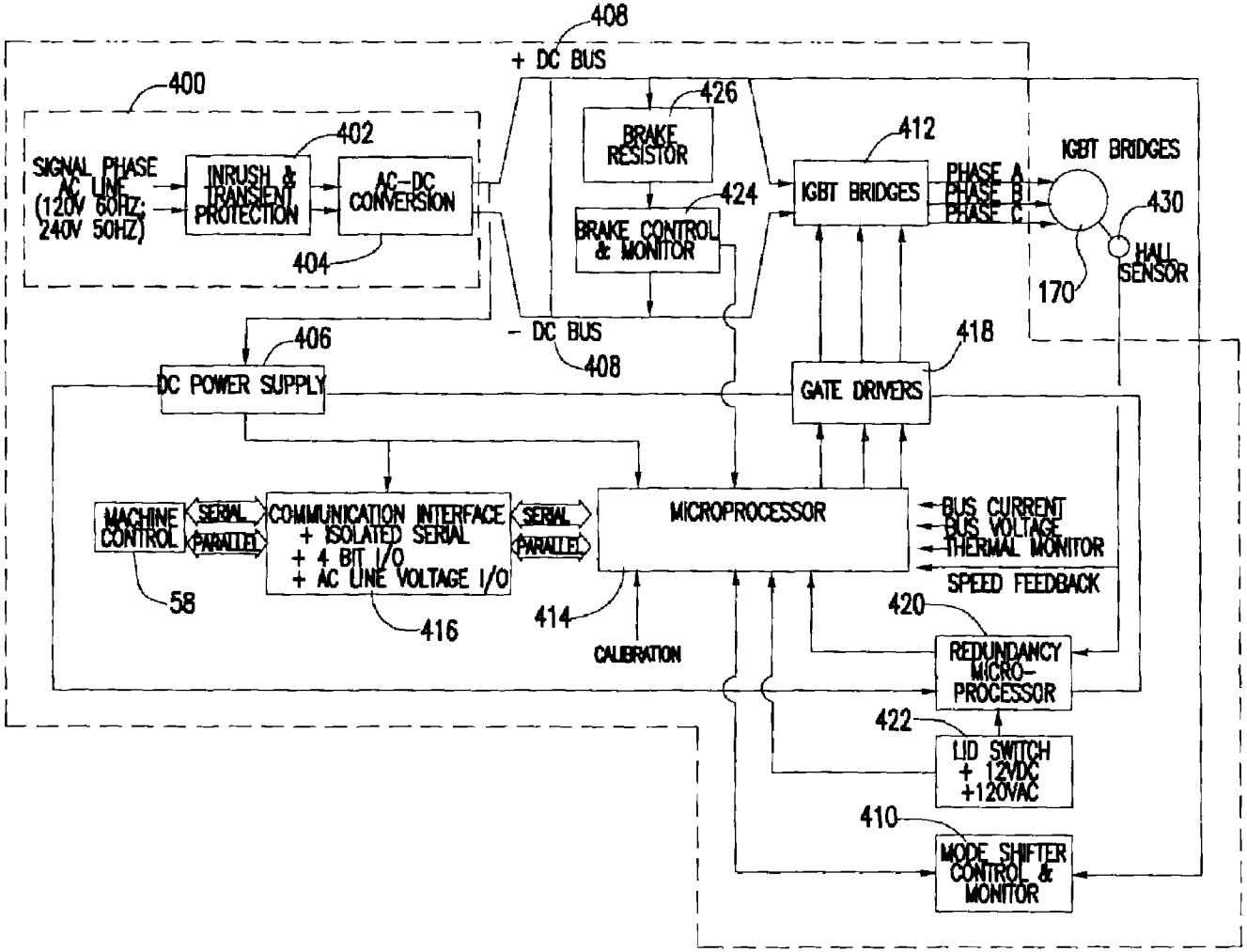
FIG. 10 is an electrical schematic block diagram of the motor controller shown in FIG. 2 electrically coupled to the motor and the mode shifter.

As described above, in one embodiment, washing machine 50 operates in a spin mode when solenoid 306 is deenergized, and operates in an agitation mode when solenoid 306 is energized. In an alternative embodiment, washing machine 50 operates in a spin mode when solenoid 306 is energized, and operates in an agitation mode when solenoid 306 is deenergized FIG. 10 is an electrical schematic block diagram of motor controller 190 electrically coupled to motor 170 and mode shifter 178. In one embodiment, motor controller 190 includes a power inlet 400 including an inrush and transient protection component 402 and an AC/DC converter 404. AC/DC converter 404 converts a single phase AC line to direct current. A portion of the direct current is stored in a DC power supply 406, and a portion of the direct current is channeled to a direct current bus 408. Direct current bus 408 is electrically coupled to a mode shifter control and monitor 410, which is coupled to and controls mode shifter 178. Direct current bus 408 is also electrically coupled to insulated gate bipolar transistors (IGBT) 412, which convert the direct current into a synthetic AC voltage known as pulse width modulation. In this embodiment, the pulse width modulation is used to power motor 170.

Motor controller 190 also includes a microprocessor 414 that is powered by DC power supply 406 and operated by a communications interface 416 that is electrically coupled to washing machine control board assembly 58. Microprocessor 414 also operates a gate driver 418 which is powered by DC power supply 406 and provides an electrical interface between microprocessor 414 and IGBT 412. Gate driver 418 also functions to provide a hardware trip current limit for washing machine 50. As such, microprocessor 414 controls the pulse width modulation pattern based on factors including, but not limited to, speed reference, tachometer 544 feedback, DC link current, and/or DC link voltage. Further, microprocessor 414 monitors a heat sink temperature of motor controller 190.

Moreover, microprocessor 414 monitors a lid switch 422, and operates a brake control 424 including a brake resistor and drip shield 426. If the lid 62 on a washing machine 50 is opened during operation, safety requires that washing machine operations be terminated immediately. This is necessary to prevent an injury which may be caused if a person sticks a hand or any other object into the machine tub during washing machine operation. Lid switch 422 transmits a signal to microprocessor 414 if the lid is opened while the washing machine 50 is operating. This causes the microprocessor 414 to transmit a signal that stops operation of washing machine 50 while the lid remains open. Specifically, microprocessor 414 transmits a control signal to the brake control 424 in order to stop operation of washing machine 50. Brake control 424 also stops washing machine 50 when the hardware trip current limit of gate driver 418 is exceeded. In addition, microprocessor 414 monitors and operates mode shifter control and monitor 410 to operate mode shifter 178.

In one embodiment, mode shifter 178 is coupled to direct current bus 408. As such, only a necessary amount of power is channeled to mode shifter 178. Specifically, mode shifter 178 requires a first amount of power to become energized. After mode shifter 178 is energized, a second amount of power is required to maintain the energized state. In one embodiment, the first amount of power is greater than the second amount of power. Thus, mode shifter 178 receives a larger amount of power while being energized than an amount of power needed to maintain mode shifter 178 in the energized state. By reducing the amount of power channeled to mode shifter 178 after mode shifter 178 is energized, an amount of heat generated by mode shifter 178 is reduced.

It is recognized that in any mechanical device there is the possibility that a part could become defective or the software controlling a processor could become defective. Any such failure could result in the microprocessor 414 not being able to process the signal received from the lid switch 422 and the washing machine 50 continuing to operate while the lid 62 remains open, creating a hazardous condition. In order to compensate for such a possibility, the motor controller 190 includes a secondary processor 420, which is powered by DC power supply 406. Secondary processor 420 is a backup microprocessor that monitors the lid switch 422 and RPM of the motor via Hall Effect sensors 430 and is configured to halt movement of the basket 70 and agitator 120 by disabling the washing machine 50 when its operation is not stopped by primary microprocessor 414 within a predetermined amount of time. Should there be any failure by primary microprocessor 414 to stop the motor 170, basket 70, or agitator 120, for example the primary microprocessor 414 does not sense the transition because of a microprocessor malfunction, or, there is a mechanical failure such as the belt 174 is slipping on the pulley; secondary microprocessor 420 transmits signals to stop motor operation and thereby the basket 70 and agitator 120. Even if primary microprocessor 414 is trying to halt operation of the washing machine, if such efforts fail, then the secondary processor 420 stops operation through disabling the motor 170 by disabling gate driver 418, which is powered by DC power supply 406. Disabling gate driver 418 disables IGBT chips 412. Gate drivers 418 are enabled until disabled by primary microprocessor 414 or secondary processor 420.

In one embodiment, a method for assembling a washing machine is provided. The method includes providing a mode shifter including a solenoid, coupling a basket and an agitator to the mode after, and coupling a motor to the mode shifter. The solenoid selectively allows the motor to rotate the basket and/or the agitator. The method also includes affixing a motor controller to the motor, and electrically coupling the motor controller to each of the mode shifter and the motor. The motor controller is in operational control communication with the mode shifter and the motor.

Figure 11:
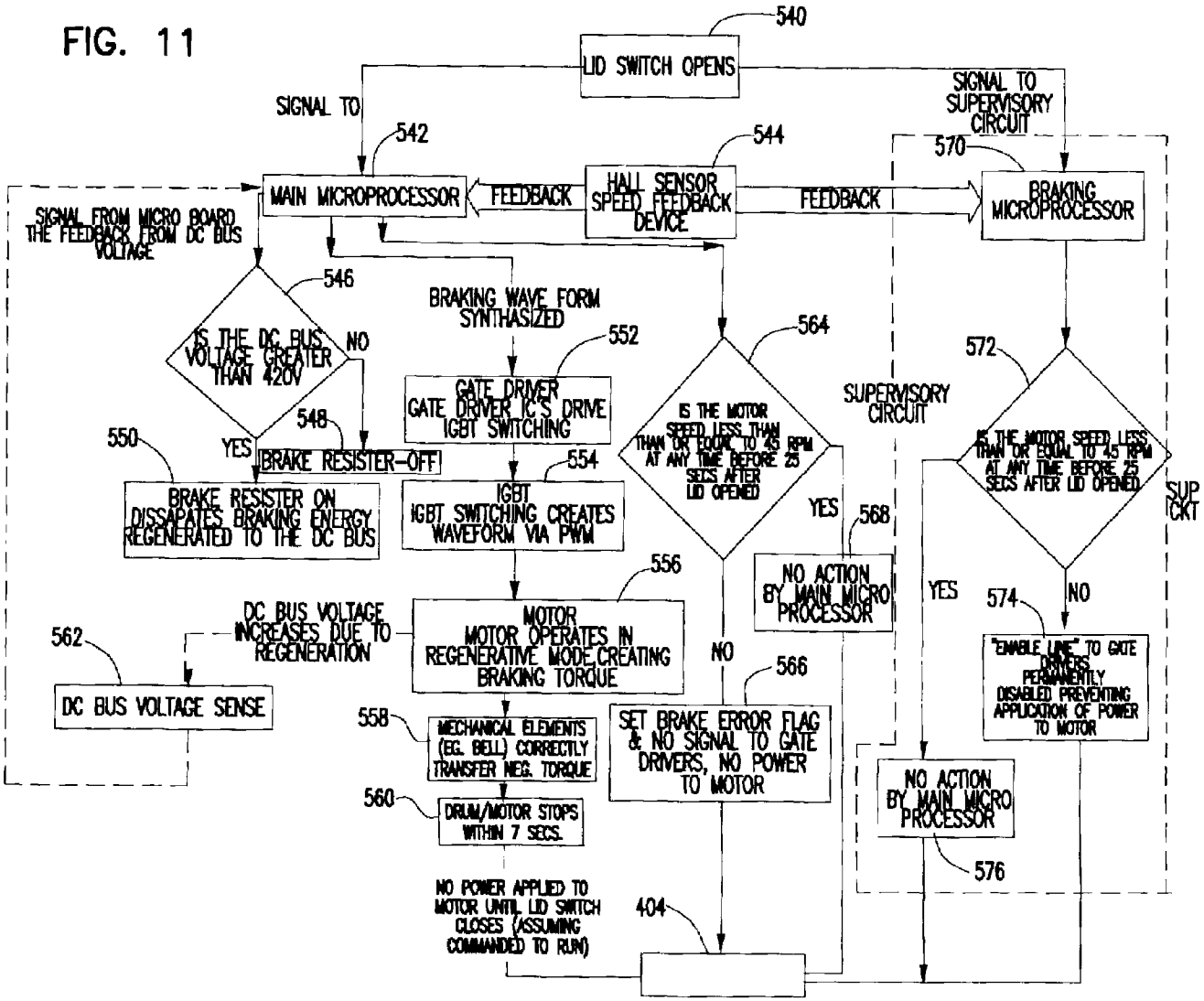
FIG. 11 is a process flow diagram illustrating operational processing performed to stop washing machine operation when its lid is opened.

FIG. 11 is a process flow diagram illustrating the flow of information and control signals within motor controller 190 when a lid switch 540 indicates that the washing machine lid has been opened. When the lid switch 540 is opened, both the primary microprocessor 542 and the secondary microprocessor 570 are aware of this change because the primary microprocessor 542 and the secondary microprocessor 570 are both continuously monitoring the lid switch. The primary microprocessor 542 and the secondary microprocessor 570 are also aware of the speed of the motor through electrical connection to a hall sensor 544. The primary microprocessor 542 receives a signal based on the feedback from the DC bus voltage and checks to determine if the DC bus voltage is greater than 420 volts 546. When the DC bus voltage is less than 420 volts the brake resistor remains off 548. When the DC bus voltage is greater than 420 volts the brake resistor is turned on 550 in order to dissipate the braking energy regenerated to the DC bus.

During operation, the primary processor 542 creates a break wave form which turns the gate drivers on and off 552 in order to enable the IGBT's to switch the motor current 554. This process causing the motor to be driven slightly slower than the rotor is turning and thereby creates a braking torque 556 causing the DC bus voltage to increase due to regeneration. The processor is constantly sensing the DC bus voltage to determine if the DC bus voltage is greater than 420 volts 546. The mechanical elements such as the belt apply the braking torque along with the motor in order to stop the drum within a predetermined period of time. In one embodiment, the period of time in which the drum may be stopped is within seven seconds 560.

When the lid switch opens, the main microprocessor 542 determines if the speed of the motor is less than or equal to forty-five RPMs at any time before a predetermined time window passes. In one embodiment, the predetermined time window is twenty-five seconds after the lid is opened. It is contemplated that the RPM value for which the main microprocessor 542 is checking within the predetermined window may be set to values other than forty-five RPMs. If the motor speed is less than or equal to forty-five RPMs at any time following twenty-five seconds after the lid is opened 564, then no action is taken 568. If the motor speed is greater than forty-five RPMs at any time following twenty-five seconds after the lid is opened 564, the primary microprocessor sets a brake error flag and no signal to gate drivers is transmitted and thereby no power is transmitted to the motor.

The secondary microprocessor 570 is constantly monitoring the speed of the motor along with the primary microprocessor 542 in order to determine if the speed of the motor is less than or equal to forty-five RPMs at any time before a predetermined time window passes. In one embodiment, the predetermined time window is twenty-five seconds after the lid is opened. It is contemplated that the RPM value for which the secondary microprocessor 570 is checking within the predetermined window may be set to values other than forty-five RPMs. If the motor speed is less than or equal to forty-five RPMs at any time following twenty-five seconds after the lid is opened 572, then no action is taken 576. If the motor speed is greater than forty-five RPMs at any time following twenty-five seconds after the lid is opened 572, the secondary microprocessor 570 disables the enable line of the gate drivers in order to prevent application of power to the motor and thereby requiring service before power may be restored to the motor.

The above-described system for powering a mode shifter of a washing machine allows a motor controller to be affixed to a motor and electrically coupled to both the motor and the mode shifter. More specifically, the system facilitates efficiently and cost-effectively coupling components of a washing machine thereby reducing an amount of wire used in the washing machine. Further, the system facilitates powering the mode shifter with a direct current voltage such that the mode shifter only receives a necessary amount of power and avoids overheating. As a result, a more efficient and more easily maintainable washing machine is provided.

Exemplary embodiments of a method and an apparatus for controlling a mode shifter for a washing machine are described above in detail. The method and apparatus are not limited to the specific embodiments described herein, but rather, steps of the method and/or components of the apparatus may be utilized independently and separately from other steps and/or components described herein. Further, the described method steps and/or apparatus components can also be defined in, or used in combination with, other methods and/or apparatus, and are not limited to practice with only the method and apparatus as described herein.

As used herein, an element or step recited in the singular and proceeded with the word "a" or "an" should be understood as not excluding plural elements or steps, unless such exclusion is explicitly recited. Further, references to "one embodiment" of the present invention are not intended to be interpreted as excluding the existence of additional embodiments that also incorporate the recited features.

While the invention has been described in terms of various specific embodiments, those skilled in the art will recognize that the invention can be practiced with modification within the spirit and scope of the claims.

What is claimed is:

1. A method for automatically halting operation of a washing machine when the washing machine lid is opened, the method comprising:

providing a motor controller including at least a primary microprocessor and a secondary microprocessor, wherein the motor controller controls operation of the washing machine via the primary microprocessor;

monitoring operation of the washing machine motor wherein the monitoring is performed by the primary microprocessor and the secondary microprocessor; and halting operation of the washing machine motor through use of the secondary microprocessor following a failure by the primary microprocessor to halt operation of the washing machine motor, wherein halting operation of the washing machine motor comprises disabling the washing machine motor, via the secondary microprocessor, even when the primary microprocessor is attempting, but still failing, to halt operation of the washing machine motor.

2. A method in accordance with claim 1 wherein the motor controller further includes a lid switch that is electrically coupled to the primary microprocessor and the secondary microprocessor, the lid switch being configured to detect and provide an indication of when the washing machine lid is open, wherein the secondary microprocessor halts operation of the washing machine motor in response to the indication of when the lid switch is open following the primary microprocessor failing to halt operation of the washing machine motor.

3. A method in accordance with claim 1 wherein the secondary microprocessor is electrically coupled to the washing machine motor and monitors the RMPs of the motor and halts washing machine operation when the motor RPMs do not fall below a predetermined RPM level within a defined time period.

4. A method in accordance with claim 1 wherein the secondary microprocessor monitors a lid switch that is electrically coupled to the primary microprocessor and the secondary microprocessor, wherein the secondary microprocessor halts washing machine motor operation following the lid switch indicating that the washing machine lid is open and the primary microprocessor failing to halt washing machine operation within a specified time period.

5. A method in accordance with claim 1 wherein the motor controller further includes a braking control system for stopping motor operation, the braking control system electrically coupled to the primary microprocessor, wherein the secondary microprocessor halts washing machine motor operation when the primary microprocessor fails to halt washing machine motor operation using the braking control system.

6. A method in accordance with claim 1 wherein the secondary microprocessor halts washing machine operation when the primary microprocessor fails to halt washing machine motor operation within a specified time period.

7. A method for automatically halting operation of a washing, the method comprising:

receiving, at a primary microprocessor and a secondary microprocessor, a first indication indicating that a lid switch is open;

receiving, at the primary microprocessor and the secondary microprocessor, a second indication indicating a motor's speed; and attempting to halt operation of the washing machine when the primary microprocessor determines that the motor's speed is above a preset motor speed during a time period after the primary microprocessor receives the first indication that the lid switch is open; and halting operation of the washing machine when the secondary microprocessor determines that the motor's speed is above the preset motor speed during the time period after the secondary microprocessor receives the first indication that the lid switch is open.

8. The method of claim 7, wherein halting operation of the washing machine comprises disabling the motor, via the secondary microprocessor, even when the primary microprocessor is attempting to disable the motor.

9. The method of claim 7, wherein attempting to halt operation of the washing machine when the primary microprocessor determines that the motor's speed is above a preset motor speed during a time period after the primary microprocessor receives the first indication that the lid switch is open comprises the primary microprocessor setting a brake error flag and not transmitting a signal gate, thereby transmitting no power to the motor.

10. The method of claim 7, wherein halting operation of the washing machine when the secondary microprocessor determines that the motor's speed is above the preset motor speed during the time period after the secondary microprocessor receives the first indication that the lid switch is open comprises disabling, via the secondary microprocessor, an enable line of gate drivers in order to prevent application of power to the motor.

11. The method of claim 10, wherein after disabling, via the secondary microprocessor, an enable line of gate drivers in order to prevent application of power to the motor, further comprising requiring service before power may be restored to the motor.

12. The method of claim 7 further comprising:

receiving a feedback signal from a DC bus;

determining, via the feedback signal, if a DC bus voltage is greater than a preset DC bus voltage;

activating a brake resistor when the DC bus voltage is greater than the preset DC bus voltage.

13. The method of claim 7, wherein the motor's speed is measured by at least one Hall Effect sensor.

14. A method for automatically halting operation of a washing machine motor, the method comprising:

receiving, at a primary microprocessor and a secondary microprocessor, a first indication that a lid switch is open;

receiving, at the primary microprocessor and the secondary microprocessor, a second indication of a washing machine motor's speed; and attempting to halt operation of the washing machine mothe when the primary microprocessor determines that the second indication of the washing machine motor's speed is above a preset motor speed during a time period after the primary microprocessor receives the first indication that the lid switch is open, wherein attempting to halt operation of the washing machine motor when the primary microprocessor determines that the washing machine motor's speed is above a preset motor speed during a time period after the primary microprocessor receives the first indication that the lid switch is open comprises the primary microprocessor setting a brake error flag and not transmitting a signal gate, thereby transmitting no power to the washing machine motor; and halting operation of the washing machine motor when the secondary microprocessor determines that the washing machine motor's speed is above the preset motor speed during the time period after the secondary microprocessor receives the first indication that the lid switch is open, wherein halting operation of the washing machine motor when the secondary microprocessor determines that the washing machine motor's speed is above the preset motor speed during the time period after the secondary microprocessor receives the first indication that the lid switch is open comprises disabling, via the secondary microprocessor, an enable line of gate drivers in order to prevent application of power to the washing machine motor; and requiring service before power may be restored to the washing machine motor after disabling, via the secondary microprocessor, an enable line of gate drivers in order to prevent application of power to the washing machine motor.

15. The method of claim 14, wherein halting operation of the washing machine motor comprises disabling the washing machine motor, via the secondary microprocessor, even when the primary microprocessor is attempting to disable the washing machine motor.

16. The method of claim 14 further comprising:

receiving a feedback signal from a DC bus;

determining, via the feedback signal, if a DC bus voltage is greater than a preset DC bus voltage;

activating a brake resistor when the DC bus voltage is greater than the preset DC bus voltage.

17. The method of claim 16, wherein the preset DC bus voltage is 420 volts.

18. The method of claim 14, wherein the preset motor speed about 45 RPMs.

19. The method of claim 14, wherein the time period is about 25 seconds.

20. The method of claim 14, wherein the washing machine motor's speed is measured by at least one Hall Effect sensor.

* * * * *